US008545039B2

(12) United States Patent
Patel

(10) Patent No.: US 8,545,039 B2
(45) **Date of Patent: *Oct. 1, 2013**

(54) LAMP BASE WITH UPGRADEABLE RECHARGING PORT AND METHOD

(76) Inventor: Bharat Patel, Boynton Beach, FL (US)

( * ) Notice: Subject to any disclaimer, the term of this patent is extended or adjusted under 35 U.S.C. 154(b) by 437 days.

This patent is subject to a terminal disclaimer.

(21) Appl. No.: 12/782,412

(22) Filed: May 18, 2010

(65) Prior Publication Data

US 2010/0321939 A1 Dec. 23, 2010

Related U.S. Application Data

(63) Continuation-in-part of application No. 11/788,424, filed on Apr. 20, 2007, now Pat. No. 7,736,033.

(51) Int. Cl.
*F21S 8/08* (2006.01)

(52) U.S. Cl.
USPC ..... 362/153; 362/183; 362/253; 362/395; 362/410; 362/414; 320/103; 320/107; 320/112; 320/113; 320/115; 307/43; 307/52; 307/60; 307/62; 307/64; 439/668; 439/909

(58) Field of Classification Search
USPC ..... 362/153, 183, 253, 395, 410, 411, 362/414; 320/103, 107, 112–115; 307/43–46, 307/52, 60, 62, 64–66, 80; 439/668, 909; 607/37, 119
See application file for complete search history.

(56) References Cited

U.S. PATENT DOCUMENTS 7,438,602 B2 * 10/2008 Montgomery et al. ..... 439/638
7,638,971 B2 * 12/2009 Guccione et al. ..... 320/114
8,067,923 B2 * 11/2011 Daniel et al. ..... 320/112
2004/0145890 A1 * 7/2004 Liao ..... 362/183
2005/0102431 A1 * 5/2005 Maniatopoulos et al. .... 709/250
2005/0156564 A1 * 7/2005 Krieger ..... 320/112
2005/0185398 A1 * 8/2005 Scannell, Jr. ..... 362/227
2006/0126243 A1 * 6/2006 Cheng et al. ..... 361/62
2007/0024236 A1 * 2/2007 Arakelian ..... 320/107
2007/0091656 A1 * 4/2007 Navid et al. ..... 363/63
2007/0093279 A1 * 4/2007 Janik ..... 455/569.1

* cited by examiner

*Primary Examiner* — Mary McManmon

(74) *Attorney, Agent, or Firm* — Osha • Liang LLP; John W. Montgomery

(57) ABSTRACT

A lamp base having an electrical device recharging receptacle configured to receive a plug from a recharging device for a portable rechargeable electronic device. The receptacle is configured as a standard automobile cigarette lighter receptacle. The receptacle includes standard cigarette lighter receptacle electrical contacts that are connected to a voltage and current conversion circuit for receiving standard household voltage and converting it into standard automotive voltage and current. An adapter receptacle is provided in the lamp base with securable replacement electrical and mechanical connection mechanism, wherein the conversion circuit provides a voltage and current to the adapter receptacle. A replaceably securable USB adapter plug comprising a second conversion circuit for converting the voltage and current provided to the adapter receptacle into a standard USB voltage and current. The replaceably securable USB adapter plug may be electrically and mechanically disconnected and replaced with an upgraded replaceably securable USB adapter plug having a third conversion circuit to convert the voltage and current provided to a different USB voltage and current.

14 Claims, 8 Drawing Sheets

LAMP BASE WITH UPGRADEABLE RECHARGING PORT AND METHOD

RELATED APPLICATIONS

This application is a continuation-in-part of co-pending and co-owned U.S. patent application Ser. No. 11/788,424 filed Apr. 20, 2007, that is relied upon for priority and that is incorporated herein by reference for all legitimate purposes.

BACKGROUND OF INVENTION

Portable electronic devices have become more and more popular in recent years. For example, portable radios, portable music recording a music playing devices, portable cellular telephones, portable hand held personal data assistants (PDAs) and portable handheld and laptop computers are very popular. Portable electronic devices are typically powered with batteries when used in a portable mode or a plug-in power supply when used in a stationary mode. Many such devices are provided with optional rechargeable batteries or with permanently installed rechargeable batteries. In such cases a plug-in power supply device may either provide operating electrical power or electrical power for recharging the rechargeable batteries or both. The voltage used by any particular portable electronic device (sometimes referred to herein as a PED) is not always the same for different PEDs. Traditionally, many PEDs are made to operate on voltages selected in increments of 1.5 volts (such as 1.5, 3, 4.5, 6, 7.5, and 9 volts for example) chosen by a manufacturer for their particular PED. This allows the use of alkaline replacement batteries that may be inserted into the PED in a series arrangement of multiple alkaline batteries of 1.5 volts. Rechargeable batteries, as for example NiCad batteries that also have a nominal full charge voltage of about 1.5 volts may also be provided in increments of to match the number of replaceable alkaline batteries that might be required. Rechargeable NiCad batteries could often be used in place of the standard alkaline replacement batteries to provide convenient rechargeable capabilities in place of the replaceable batteries.

In many instances a manufacture of a PED would also provide a separate power supply or recharging devices together with the PED. After market power supply/recharging devices have also been available in the market place. Such recharging devices were used to convert standard electrical power (current at a given voltage) into a required charging current and voltage for the particular PED to operate or for the appropriate battery or batteries to be charged. For example, a PED may operate on 7.5 volts DC and the expected available source power or a standard input power to the recharging device might be a standard US household voltage of 110-120 volts AC. For example, 110 VAC to 120 vAC is usually available in most US homes, hotels, and buildings at wall sockets to provide at least about 10 amps of current and up to about 60 amps of current, depending upon the building wiring and fuses or circuit breakers. Another example of a standard available power is a standard automotive voltage of 12 volts DC, usually provided by a large capacity lead acid battery that is carried onboard most automobiles, trucks and other vehicles and that is kept charged during running of the vehicle or recharged by an alternator. Usually automobiles have wires and circuits carrying at least about 5 amps and up to about 50 amps depending upon the automobile wiring and fuses. The type of charging device circuitry is different for the household Alternating Current (AC) and for the automotive Direct Current (DC). The operating power supply or the re-charging devices convert the input electrical voltage and current into an appropriate operating or charging voltage and current. The voltage and current that is appropriate depends upon the requirements of the PED and the design and number of rechargeable batteries for which the recharging device is designed. Such recharging devices are typically provided with either a household plug for receiving household AC electrical power or an automotive electrical receptacle generally known as a cigarette lighter plug. For many years almost all automobiles have been provided with a dashboard mounted plug-in cigarette lighter that conveniently provides access to an automotive electrical circuit connected to the 12 volt battery and/or the alternator of the automobile. The user typically has an option of purchasing one type of re-charger for use with household electrical power in a building or another type for use with automotive electrical power in a vehicle. A traveler may have one charger for use while driving and another for use when in a home, hotel, or building at a destination. It will be noted that different voltage and current conversion circuitry is required, even for the same PED, depending upon whether the power source will be household AC or automotive DC. Thus, two recharging devices were often carried by travelers to accommodate both or either in-building operation/recharging and car operation/recharging as might be available at a time that the charge of the batteries of the PED became insufficient for proper operation.

In more recent years, many different types and voltages of batteries have been developed and adopted by manufactures. For example, nickel metal hydride (NiMetal Hydride) cells have a nominal voltage of 1.2 volts, although at full high charge they may be as high as 1.5 volts. NiMetal Hydride cells can generally provide a direct replacement for alkaline batteries in many applications. Other examples include lithium ion (Li+) batteries that typically are chargeable to about 4.1 to 4.2 volts for single cells and lithium polymer (Li-Poly) batteries typically are chargeable to about the 4.3 to 4.4 volts range. In many modern portable electronic devices these types of rechargeable batteries are often built right into the portable electronic devices or attached as a specially shaped cell to be part of the PED. Such PEDs are typically provide with a separate recharging unit having appropriate recharging circuitry and connectable to the portable electronic device with a special plug and cord adapter. The type of circuitry and plug for a particular recharging unit will differ depending upon the intended source of power, 115 v AC, 12 v DC or another voltage and current that may be "standard" in other countries outside of the US. In many instance a recharging circuit may be built into the PED and only an adapter cord with the required plug connections might be separately provided to connect the PED to a standard power source. The adapter cord still needs to match the intended power source and often travelers purchase both types (AC plug and DC car charger plug) so that charging is available with either a household current outlet or an automobile cigarette lighter receptacle. Such adapter cords or plug-in charging units typically connect to the PED with a plug and receptacle that is unique or proprietary to the particular PED or the particular manufacturer. As used here the term "unique" as applied to the connector may mean that the manufacturer has selected one of many available plug and receptacle configurations selected or produced by the manufacturer. It is unique because there is no true adopted standard for all PEDs. Thus, one end of the connector or cord plus into the PED and the other end of the connector or cord is be adapted to one or the other of a household plug or a cigarette lighter plug. It continues to be appropriate for a traveler to carry two recharging units or two cords to be able to accommodate either automobile operation/recharging or in-building operation/recharging.

Certain advances in computer technology have led to the development of a connector known as a universal serial bus (USB). A USB connector is often called a USB port and it includes a generally rectangular shaped male and female plug-in connection with a number of slide together contact electrical connection terminals. The terminals are arranged in a standardized pattern and when connected provide for rapid data transfer and information communication between computers, PEDs, and data storage devices, such as for example between two computers, between a computer and a PED, or between a computer and a data storage device. To facilitate the use of inexpensive data storage devices and other peripheral devices, the USB ports also include electrical power terminals in addition to the data connection terminals. Currently, most USB ports provide electrical power from an electrical device such as a computer in which the USB port is mounted. The electrical power available for transmission with a USB port is currently standardized at 5 volts DC for available USB protocol devices whether USB 1.1 or USB 2.0. The electrical power is provided at 5 volts DC and 100 μamps, for a low power USB port, and up to 500 μamps for a high power USB port. Some USB operating circuitry allows for a peripheral device to specify (with an appropriate data signal) the amount of current required in increments of 100 μamps, up to a total of 500 μamps.

Some portable electrical devices and some operating/recharging units, such as those with recharging circuits for NiCad batteries, circuits for nickel metal hydride batteries, circuits for lithium ion batteries, or circuits for lithium polymer batteries, have now been adapted to connect to USB ports. Such operating power/battery recharging units convert the available 5 v DC into an appropriate recharging voltage and current for the particular PED. A wide variety of recharging devices and cords are available from various portable electronic device manufactures and also from after market providers of recharging units. In the case of PEDs that are designed with onboard charging circuitry and that use USB voltage and current, a USB cable may be required to make a connection to a powered USB port that can typically be found on most modern personal computers.

Travelers with any of a variety of available portable electronic devices often no longer have the option to carry spare replacement alkaline batteries, but instead travel with the recharging cords or recharging devices specially adapted for each of the portable electrical devices being carried by the traveler. This can often lead to the carrying of two times as many cords/recharging devices as the traveler has portable electronic devices.

SUMMARY OF INVENTION

In general, in one or more aspects, the invention relates to a lamp base having an electrical device recharging receptacle configured as a standard automobile cigarette lighter receptacle to receive a plug from a recharging unit for a rechargeable portable electronic device (PED). The lamp base includes a voltage and current conversion circuit for receiving a standard household voltage and converting the standard household voltage and current into a standard automotive voltage and current.

In one or more embodiments, a lamp base has a power source connected to the lamp base, wherein a standard household electrical current at standard household voltage is received into the lamp base. A light fixture is attached to the lamp base. A direct circuit is included for connecting the standard household electrical current and voltage to the light fixture. A snap-lock receptacle in the lamp base electrically connected to the conversion circuit, wherein the conversion circuit provides a voltage and current to the snap-lock receptacle. A replaceable snap-lock USB adapter plug comprising a second conversion circuit for converting the standard automobile electrical voltage and current provided to the adapter receptacle into a standard USB voltage and current and so that the replaceable snap-lock USB adapter plug may be unlocked, removed, and replaced with an upgraded replacement snap-lock USB adapter plug having a third conversion circuit to convert the voltage and current provided to a different USB voltage and current.

In one or more embodiments a lamp base system for operating and recharging a portable electronic device is provided with a lamp base. A power source connected to the lamp base, wherein a standard household electrical current at standard household voltage is received into the lamp base. A light fixture attachment is attached on the lamp base, wherein an illumination element holding device is attached to the base to form the lamp. A direct circuit is included for connecting the standard household electrical current and voltage to the light fixture. An automotive cigarette lighter receptacle is held in the lamp base for connection to an operating and recharging unit for a portable electronic device, wherein the automotive cigarette lighter receptacle includes an electrical plug receiving portion and a mechanical securing portion. A conversion circuit is connected between the power source and the automotive cigarette lighter receptacle, wherein the standard household electrical current and voltage from the power source is converted to a standard automotive voltage and current, wherein an operating and recharging unit that requires standard automobile electrical voltage and current may be plugged into the automotive cigarette lighter held in the lamp base for operating and recharging the portable electronic device. A replaceably securable USB adapter is provided including an electrical plug portion and a mechanical engagement portion so that the electrical plug portion connects to the plug receiving portion of the cigarette lighter receptacle when the mechanical engagement portion of the adapter engages the mechanical securing portion of the cigarette lighter receptacle and having a USB conversion circuit for converting the voltage and current provided to the cigarette lighter receptacle into a standard USB voltage and current and so that the USB adapter may be removed and securely replaced with an upgraded USB adapter having a different USB conversion circuit to convert the voltage and current provided to a different USB voltage and current.

In one or more embodiments, a lamp base is provided with a snap-lock receptacle for an upgradeable snap-lock USB power port adapter plug.

Other aspects and alternative useful embodiments of the invention will be apparent from the following description and the appended claims.

DETAILED DESCRIPTION

One or more embodiments of the invention will be described with reference to the accompanying figures. Like items in the figures are shown with the same reference numbers.

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
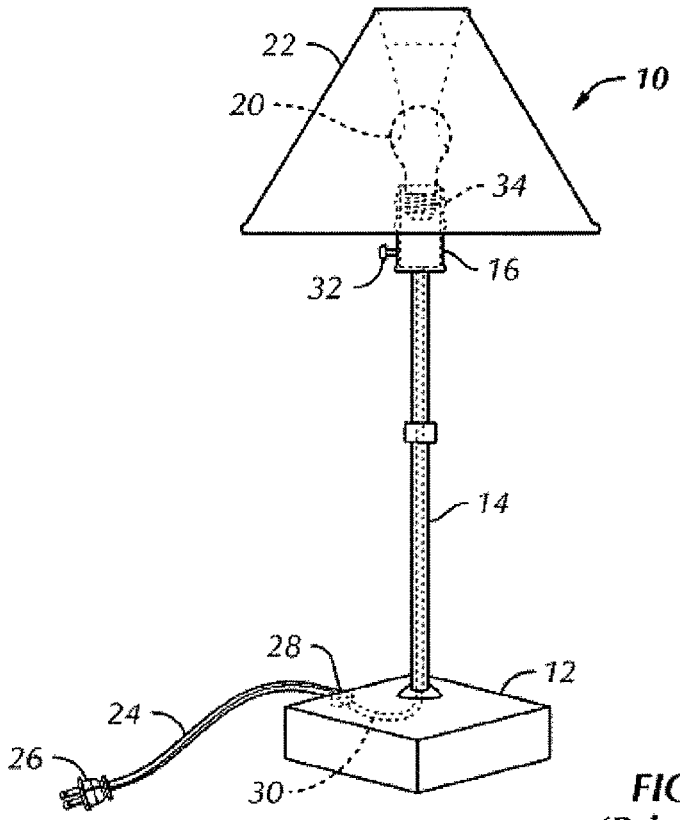
FIG. 1 (Prior Art)
FIG. 1 shows a prior art table lamp.

FIG. 1 shows a prior art table lamp 10. The lamp 10 includes a lamp base 12 by which the lamp 10 is supported from a table, floor or other surface. There is a support 14 such as a pole or pedestal; that supports a light holding fixture 16. The light holding fixture 16 holds an illuminating element 20 such as a bulb 20 (shown in hidden lines). The may be a light diffusing element 22 such as a shade 22 or a frosted lens or the like. The lamp is provided with an electrical power cord 24 connectable by a plug 26 at one end of the cord to a household electrical outlet and connected at the other end 18 into the lamp base 12 and then via an internal circuit 30 to an on/off switch 32 by which household electrical power in the form of voltage and current (in the US typically 110 VAC to 120 VAC and up to about 10 to 20 amps) is provided through the light fixture to the coupler 34 of the bulb 20.

Figure 2:
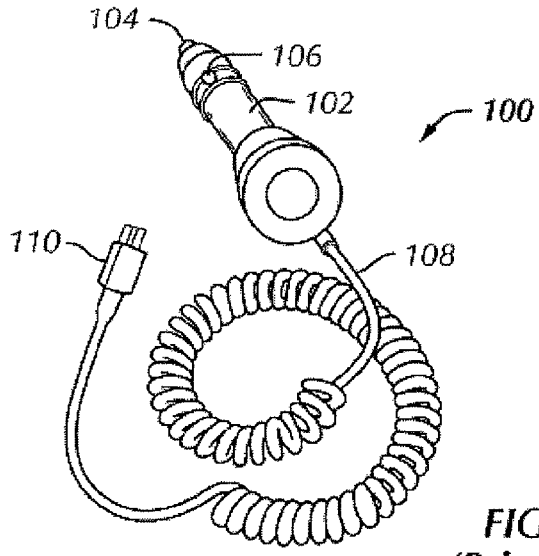
FIG. 2 (Prior Art)
FIG. 2 is a perspective view of a prior art automotive style operating/recharging unit for a portable electronic device (PED).

FIG. 2 shows a perspective depiction of an operating and/or recharging device 100 with an automotive style plug 102 for insert into an automotive cigarette lighter receptacle (not shown in FIG. 2). It will be understood that there are contacts 104 and 106 that are designed to engage with and receive electrical power from the automobile receptacle. A cord 108 conveys the electrical power to a PED connector plug 110. It will be understood that the operation and/or recharging device 100 might convey the a standard automotive voltage and current directly to the PED or it might include an internal circuit 112 (shown in phantom lines as an optional component) by which the automotive voltage and current is converted to a different voltage and current prior to conveying it to the PED.

Figure 3:
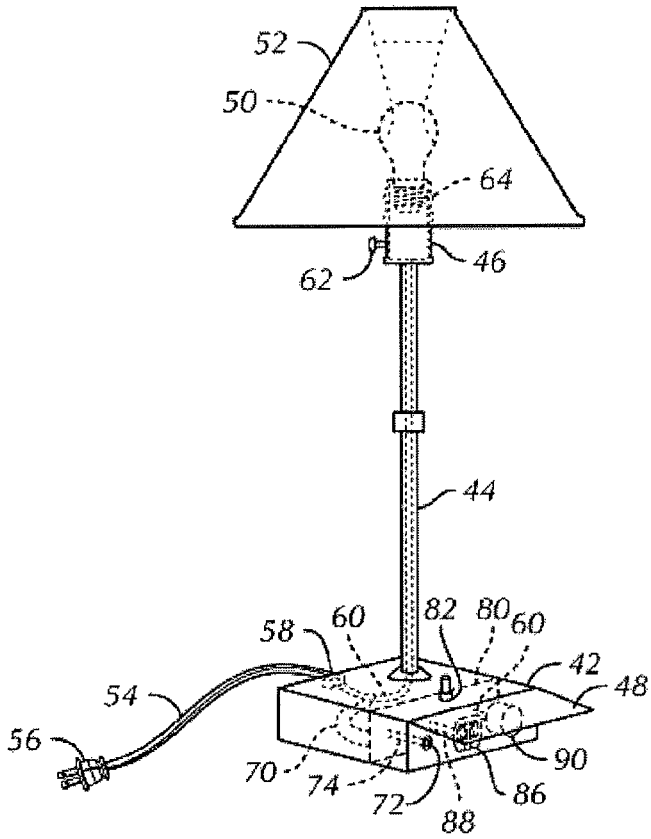
FIG. 3 is a perspective view of a table lamp with a lamp base in accordance with one or more embodiments of the invention.

FIG. 3 shows a perspective view of a table lamp 40 with a lamp base 42 in accordance with one or more embodiments of the invention. The lamp base 42 supports the lamp 40 from a table, floor or other surface. There is a support 44 such as a pole or pedestal; that supports a light holding fixture 46. The light holding fixture 46 holds an illuminating element 50 such as a bulb 50 (shown in hidden lines). The may be a light diffusing element 52 such as a shade 52 or a frosted lens or the like. The lamp 40 is provided with an electrical power cord 54 connectable by a plug 56 at one end of the cord to a household electrical outlet and connected at the other end 58 into the lamp base and then via one internal circuit 60 to an on/off switch 62 by which household electrical power, in the form of voltage and current (in the US typically 110 VAC to 120 VAC and up to about 10 to 20 amps), is provided through the light fixture to the coupler 64 to the bulb 50.

Another internal connection 70 connects the power cord 54 to another circuit 80 by which the voltage and current is converted to a different voltage and current that may be conveyed to one or more outlet receptacles. An activation switch 82 may be provided by which the conversion circuit 80 is activated to convert the input electrical voltage and current from connector 70 into one or more the different output voltages and currents. According to one embodiment of the invention the household voltage and current are converted to and output voltage and current that corresponds to a standard automotive voltage and current that is connected at 84 to an automobile cigarette lighter receptacle 90. In this example US standard household voltage is nominally 115 VAC and the available current to the lamp is 10-20 amps (depending upon the wiring to the receptacle (not shown) into which plug 56 might be inserted. In automobiles manufactured in the US, and in most vehicles manufactured throughout the world, the standard automotive voltage is nominally 12 volts DC. Thus, it is useful for the conversion circuit to convert 115 VAC into 12 volts DC. It is also useful that the receptacle 90 is formed as a standard cigarette lighter receptacle so that all operating and/or recharging devices made for use in an automobile can be used in the receptacle 90 in the lamp base.

An indicator light 72 may also be connected to the conversion circuit 80, as for example by a connector 74. For convenience, a household receptacle 86 may also be held by the lamp base 42 and may be provided with standard household voltage and current by connector 88. In one or more embodiments a closure panel 48, such as a hinged door 48 may be connected to overlay a face 92 of the lamp base 42 at which the receptacle 90 is held, so that the receptacle 90 may be hidden from view and so that inadvertent collection of dust or insertion of objects and the like is avoided when the receptacle 90 is not in use.

Figure 4:
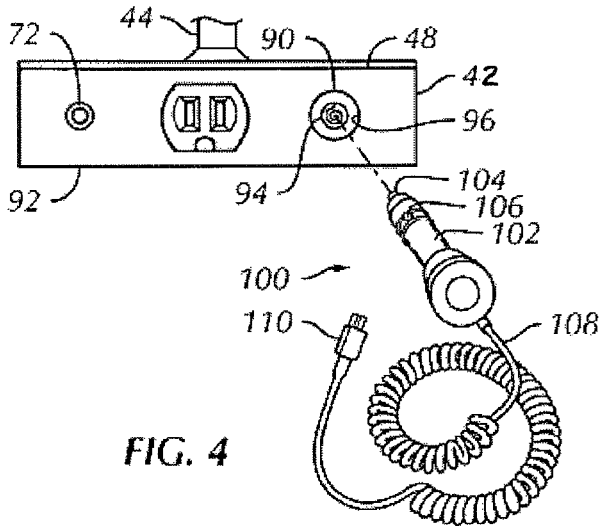
FIG. 4 is a front view of a lamp base having an automotive cigarette lighter receptacle and an operating/recharging unit for use with the automotive cigarette lighter receptacle in accordance with one or more embodiments of the invention.

FIG. 4 shows a front view of face 92 of a lamp base 42 having an automotive cigarette lighter receptacle 90. An operating/recharging unit 100 is depicted having a plug 102 with contacts 104 and 106 that correspond to the contacts 94 and 96 of receptacle 90. The automotive style plug 102 may be removably inserted into the automotive style receptacle 90 so that contacts 94 and 104 are electrically coupled and contacts 96 and 106 are electrically coupled. The operating/charging unit 100 (that is obtained by the user of a PED for the particular PED) is therefore useable either in an automobile or in a building where a lamp with the lamp base according this embodiment of the invention is plugged in to a household receptacle The inventor has found that it is useful to provide such a lamp base for use with lamps placed in hotel or motel rooms for the convenience of travelers. In this way only one operating/recharging unit needs to be carried by the traveler and the same operating/recharging unit is usable both in car or other vehicle and also in a hotel room. In the case where the lamp is placed on a table top, on a counter top, on a dresser, on a night stand, or another elevated surface, a plugged in operating/recharging unit is easily and conveniently plugged in and also it is in plain view so that the opportunity to forget a unit plugged into a wall receptacle is reduced. It has been found by the inventor that operating/recharging units of the household plug type are left plugged in hotel rooms on a frequent and regular basis by travelers. Because the traveler is often traveling in a vehicle, the missing recharging unit for the household receptacle is not missed for some time as the automobile unit is next to be used. Later, often at the next destination when trying to plug into a house receptacle, the user discovers the missing charging unit and must go to the effort of retrieving the unit from the previous hotel or to the expense and effort of obtaining a replacement.

Figure 5A:
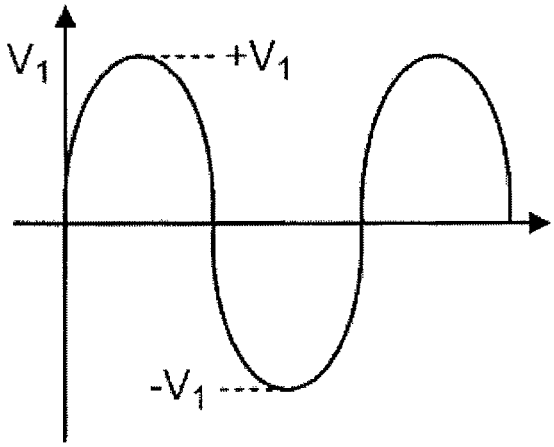
FIGS. 5A. 5B and 5C show a graphical representation of an alternating voltage and current input signal (5A), a schematic view of an AC to DC conversion circuit or rectifier (5B), and a graphical representation of a DC output voltage and current signal (5C).

FIG. 5A shows a graphical representation of an alternating voltage and current input signal as might be representative of a household voltage and current. The wave form of the voltage signal may for example be sinusoidal as depicted and alternates from a positive voltage to a negative voltage (for example between plus 115 v and minus 115 v in the US and between plus 230 v and minus 230 v in other countries.)

Figure 5B:
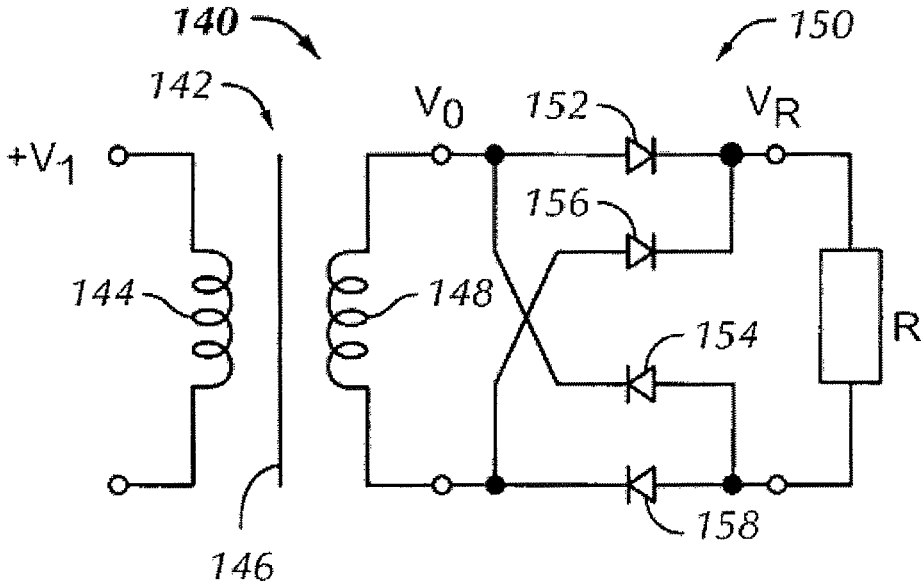

FIG. 5B shows a schematic view of an AC to DC conversion circuit 140, commonly called a rectifier and in this example a bridge rectifier. The rectifier circuit typically includes a transformer 142 composed of an input coil 144 an iron core 146 and an output coil 148. A voltage raise or drop can be accomplished by having different numbers of windings of the coils 144 and 148. More windings on the output coil will step up the voltage and fewer windings on the output coil will step down the voltage. A diode bridge 150 is formed of one pair of oppositely directed diodes 152 and 154 that are connected to one terminal of the output coil +Vo and another pair of oppositely directed diodes 156 and 158 that are connected to the other terminal of the output coil −Vo so that the load resistance voltage Vr is always positive (or always negative if the diode directions are all reversed) so that a direct current is obtained to power a load indicated as a load resistance R.

Figure 5C:
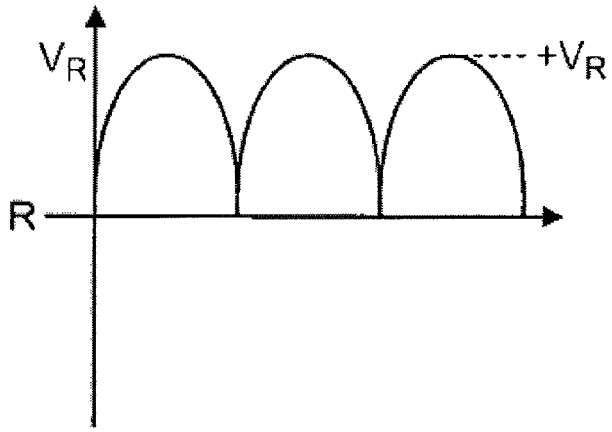

FIG. 5C shows a graphical representation of an example DC load voltage from the rectifier circuit 5B. It shows a signal that is direct current because it is always positive (or it may be always negative) and there is a ripple in the rectified voltage Vr due to the sinusoidal increase and decreases of the rectified AC input voltage Vi. The DC voltage Vr may also be smoothed with one or more known capacitor and resister circuits (not shown) to provide a smoother or more constant DC voltage. In some cases a smooth voltage might be expected from an automotive circuit, as for example where the electrical power if obtained from a battery. However in other in stances the voltage generated or provided from an alternator of running vehicle may be more similar to the rippled signal depicted in FIG. 5C.

Figure 6:
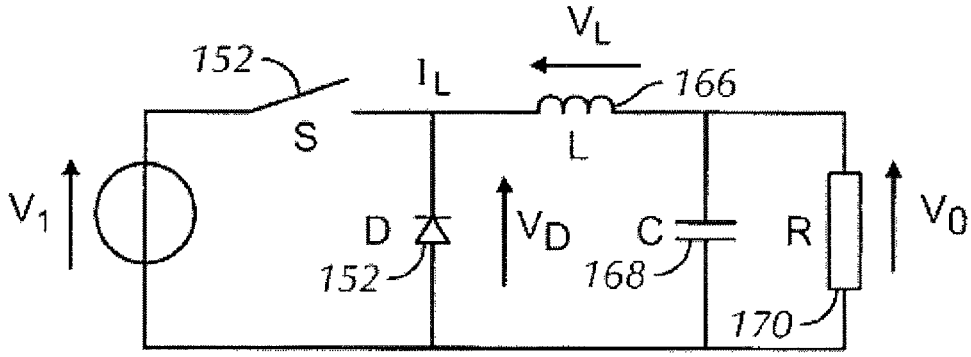
FIG. 6 is a schematic view of a DC to DC conversion circuit.

FIG. 6 shows a schematic view of a DC to DC conversion circuit 160 that may for example be in the form of a switch mode power supply (SMPS) as depicted. For purposes of illustration and with the expectation that normally the input household voltage as rectified cy the circuit of 5B will be greater than the standard automotive voltage of about 12 volts, a step down converter 160 is shown that is also known as a buck converter because it "bucks" or reduces the voltage. Although one example circuit 160 is shown it will be understood by those of ordinary skill in the art based upon this disclosure that other types of SMPS converters or alternatively linear converters might be used without departing from aspects of various embodiments of the invention. In the circuit depicted, Vi is an input DC voltage (see FIG. 5C) as might be provided by the rectifier circuit of FIG. 5B. An electronic switch (S), at 162, cycles on and off at a predetermined frequency. Thus, the switch 162 alternates between connecting the remainder of the circuit to the input voltage Vi and disconnecting the voltage to the circuit. By use of a diode (D) at 164, and an inductor (L), at 166, and alternately connecting the source voltage to this part of the circuit, energy is stored in the inductor 166 and capacitor 168. When the circuit is disconnected from the voltage the stored energy is discharged as electrical current from the inductor and capacitor into the load that is represented by a capacitance (C), at 168, and a resistance (R), at 170. The energy storage of the inductor, and thus the voltage, may be determined by selection of the components. The voltage can be regulated to a fixed voltage during varying current demands by adjusting the on/off duty cycle. Self regulating SMPS circuits are available. In one or more embodiments the conversion circuit 80 of FIG. 3 will include both an AC to DC rectifier circuit, for example circuit 140 of FIG. 5B, and a DC to DC conversion circuit, and for example circuit 160 of FIG. 6.

Figure 7:
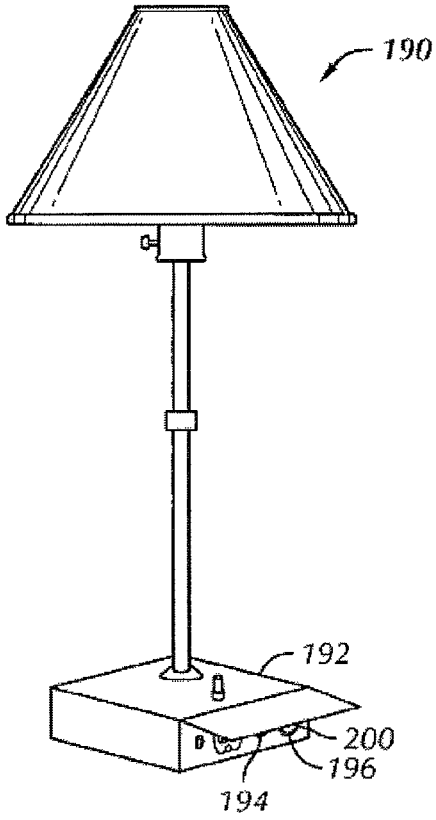
FIG. 7 is a perspective view of a lamp with a lamp base having an automotive cigarette lighter receptacle, a threaded receptacle for attachment of a USB port power unit and an operating/recharging unit for use with the automotive cigarette lighter receptacle in accordance with one or more embodiments of the invention.

FIG. 7 shows a lamp 190 with a lamp base 192 having an automotive cigarette lighter receptacle 194 for attachment of an operating/recharging unit 100 for use with the automotive plug 102 and a threaded receptacle 196 for attachment of a USB port power unit (not shown in FIG. 7, see FIGS. 9, 10 and 11) in accordance with one or more embodiments of the invention.

Figure 8:
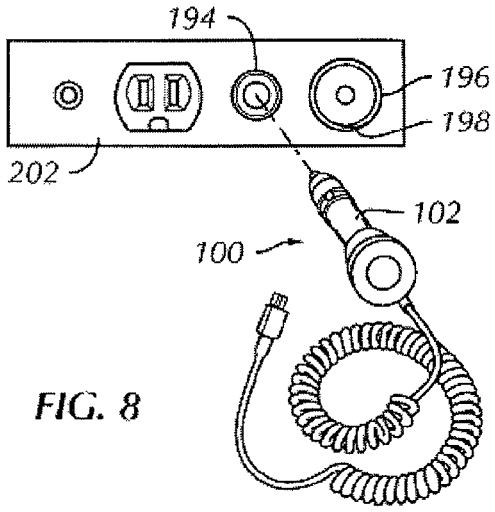
FIG. 8 is a front plan view of a face of the lamp base of FIG. 7 having an automotive cigarette lighter receptacle, a threaded receptacle for attachment of a USB port power unit and an operating/recharging unit for use with the automotive cigarette lighter receptacle.
Figure 9:
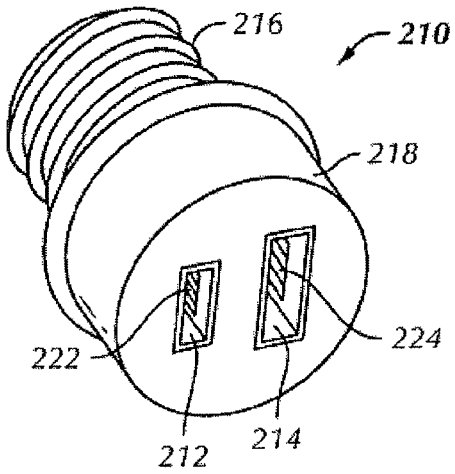
FIG. 9 is a perspective view of an upgradeable threaded USB converter with dual power ports.

Referring to FIGS. 8 and 9 together, FIG. 8 shows a face 202 of the lamp base 192 of FIG. 7. An automotive cigarette lighter receptacle 194 is formed in the face 202 or other wise held in the lamp base 192. A threaded receptacle 196 for attachment of a USB port power unit (210 of FIG. 9) is also formed in the face 202 or otherwise held in the lamp base 192. The automotive cigarette lighter receptacle 192 is of standard size and configuration for receipt of a plug 102 of an operating/recharging unit 100 for use with a standard automotive voltage and current.

FIG. 9 shows an upgradeable threaded USB adapter 210 with dual power ports 212, for a USB 1.1 version power port, and 214, for a USB 2.0 version power port. The upgradeable threaded USB adapter 210 includes external threads 216, sized for threaded engagement into internal treads 198 of the receptacle 196. The USB ports 212 and 214 have internal electrical contacts 222 and 224, respectively, corresponding to the electrical power contacts of standard USB port connectors. Under current standards the voltage for either USB version 1.1 or USB version 2.0 are at 5 volts DC. The 5 volts DC may be supplied by an additional circuit on the conversion circuit 80 within the lamp base. The inventor has found that it is useful to provide the USB threaded receptacle with a DC voltage and current. This may usefully be 20-24 volts DC and may alternatively be the same DC voltage as supplied to the automotive receptacle 194 (nominally 12 V DC). Twenty to twenty-four volts is as high as manufacturing standards might permit, without other features such as double insulation, to avoid inadvertent shocks. Alternatively use of 12 volts DC is sufficiently low and also permits using only one conversion circuit for both the automotive receptacle and for the USB adapter receptacle. Another DC to DC conversion circuit 226 is provided within the USB adapter body 218 that converts the receptacle DC voltage to the standard USB voltage, presently 5 volts DC. The DC to DC conversion circuit 226 may be similar to the buck converter 160 depicted in FIG. 6. There are often changes in the standards for different kinds of technology such as USB ports. The use of a threaded USB adapter 210 allows for this possibility so that the threaded USB receptacle receiving either the high 20-24 volts or the lower 12 volts DC can convert to the lower 5 volts DC. If the standard voltage is lowered or raised an adapter with a different conversion circuit can be securely threaded into the treaded receptacle to provide the new standard voltage without replacing the entire lamp.

Figure 10:
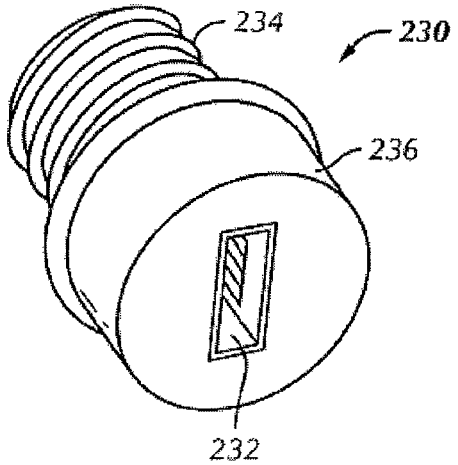
FIG. 10 is a perspective view of an upgradeable threaded USB converter with a single power port and FIG. 11 is a back view of either of the upgradeable threaded USB converters of FIG. 9 or 10.

FIG. 10 shows a perspective view of an upgradeable threaded USB converter 230 with a single USB power port 232 with threads 236 and body 238.

Figure 11:
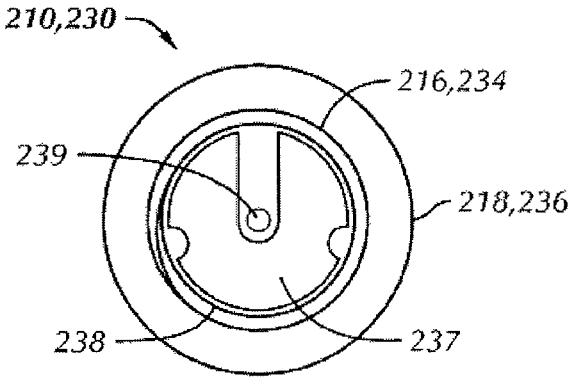

FIG. 11 shows a back view of the upgradeable threaded USB converters of either FIG. 9 or FIG. 10. In this view the threads 218 or 236 hold one electrical contact 238 (to contact conductor 197 of FIG. 8 and another electrical contact 239 is formed at the bottom of the adapter to contact conductor 199 of FIG. 8. An insulation disc 237 may be disposed between the contacts 238 and 239.

Figure 12:
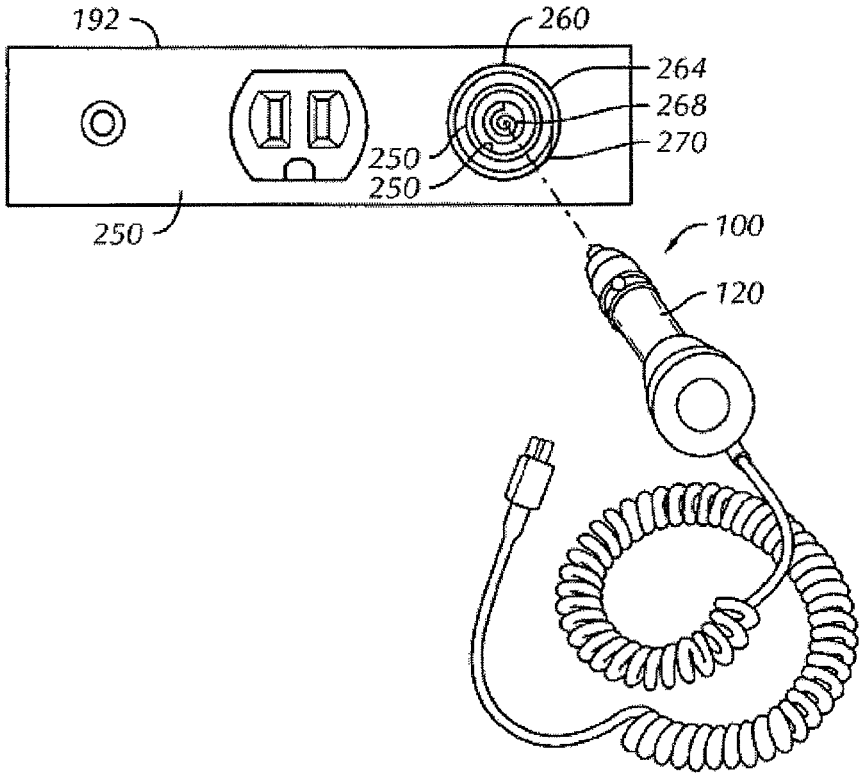
FIG. 12 is a front view of a lamp base having a dual purpose automotive cigarette lighter receptacle that is also threaded, so that the dual purpose receptacle may receive either an operating/recharging unit having an automotive cigarette lighter plug or a threaded, upgradeable USB power port unit in accordance with one or more alternative embodiments of the invention.
Figure 13:
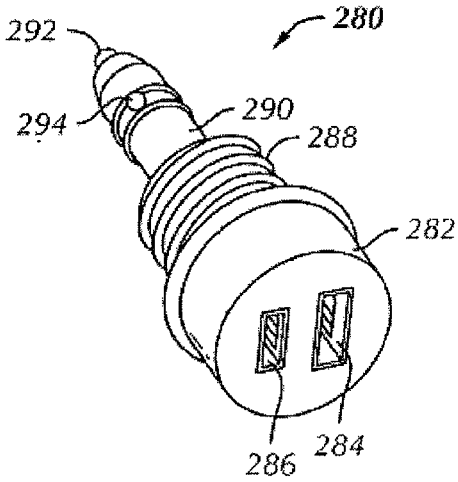
FIG. 13 is a perspective view of an upgradeable threaded USB converter with a USB power port adapted to electrically engage contacts in an automotive receptacle.

FIGS. 12 and 13 show a face 250 of lamp base having a dual purpose automotive cigarette lighter receptacle 260 that is also threaded and an upgradeable USB power port unit 280 having threads 288 and an automotive type plug 290. The dual purpose receptacle 260 may receive either an automotive operating/recharging unit 100 having an automotive plug 102, or the upgradeable USB power port unit 280 having threads 288 and an automotive type plug 290. The receptacle 260 has an automotive plug receiving portion 262 formed in from the face 250 and down to a maximum depth. The receptacle also has a treaded plug receiving threaded portion 264 formed from the face 250 and to a partial depth at the start of the plug receiving portion 262. The plug portion has an electrical connector 266 therealong the inside and another electrical connector 268 at the maximum dept or at the bottom of the receptacle.

FIG. 13 shows the upgradeable threaded USB converter 280 with one or more USB power ports 284 and 286 formed in a body 282. Threads 288 are formed along a portion of the adapter 280 and a plug portion 290 that has a smaller diameter than the minimum diameter of the treads 288 is formed along another portion of the adapter 280. The automotive plug portion includes a first electrical contact 292 and a second electrical contact 294. The plug 290 and electrical contacts 292 and 294 are formed to fit into the standard size plug portion 262 of the receptacle 260 so that the electrical contacts 292 and 294 engage conductors 268 and 266, respectively. Alternatively, although not at the same time, a standard automotive cigarette lighter plug 102 can also be received and electrically engage with the contacts in the dual purpose automotive receptacle.

Figure 14:
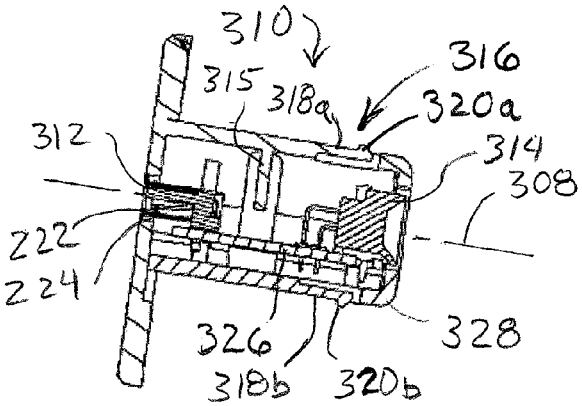
FIG. 14 is a side cross-sectional view taken along an axial centerline of an upgradable snap-lock USB converter plug.

FIG. 14 is a side cross-sectional view taken along an axial centerline 308 of an upgradable USB adapter plug 310 that may include one or more power ports 312, for example, USB 1.1 version power ports, USB 2.0 version power ports, or other versions as may come to be available. The upgradeable adapter plug includes an electrical connection portion 314 for receiving electrical power from the power conversion circuit in the lamp base and a mechanical engagement portion 316 for replaceably mechanically securing the USB adapter plug 310 into an adapter receptacle 330 (shown in FIG. 15). The upgradeable and replaceably securable USB adapter plug 310 includes a USB conversion circuit 326 for converting the voltage and current provided, to the adapter receptacle through the electrical connection 314, into a standard USB voltage and current that is then provided at the one or more power ports 312. The upgradeable replaceably securable USB adapter plug 310 may be unsecured both mechanically and electrically and replaced with an upgraded USB adapter plug having a different USB conversion circuit 326 to convert the voltage and current provided to a different USB voltage and current. In one or more embodiments the upgradable replaceably securable USB adapter plug 310 may be an upgradeable snap-lock USB adapter, as shown in FIG. 14, that includes as the mechanical engagement portion 316 external fingers 318*a* and 318*b*, on opposed sides of the upgradable replaceably securable USB adapter plug. Each of the fingers may be constructed to have a resilient portion 320 and a hook portion 322. A disengagement mechanism 315 may be provided to allow tool operated mechanical retraction of the mechanical connection such as by allowing inward collapse of the hook portion 322. The electrical connection portion 314 may include mating male and/or female connector prongs or contacts. The USB port 312 shown in FIG. 14 has internal electrical contacts 222 and 224, respectively, corresponding to the electrical power contacts of standard USB port connectors.

Figure 15:
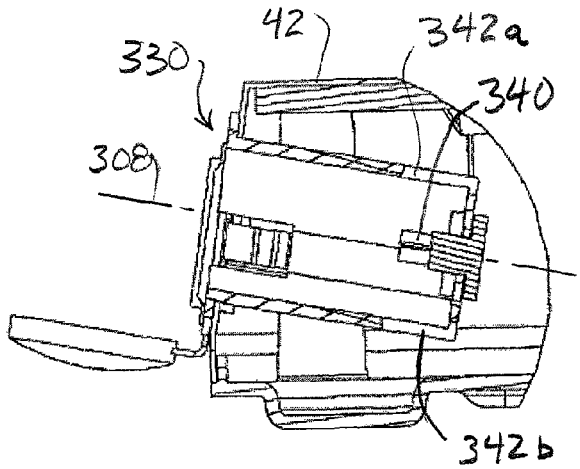
FIG. 15 is a side cross-sectional view taken along an axial centerline of a receptacle in a lamp base, the receptacle configured for the upgradable snap-lock USB converter plug of FIG. 14.
Figure 16:
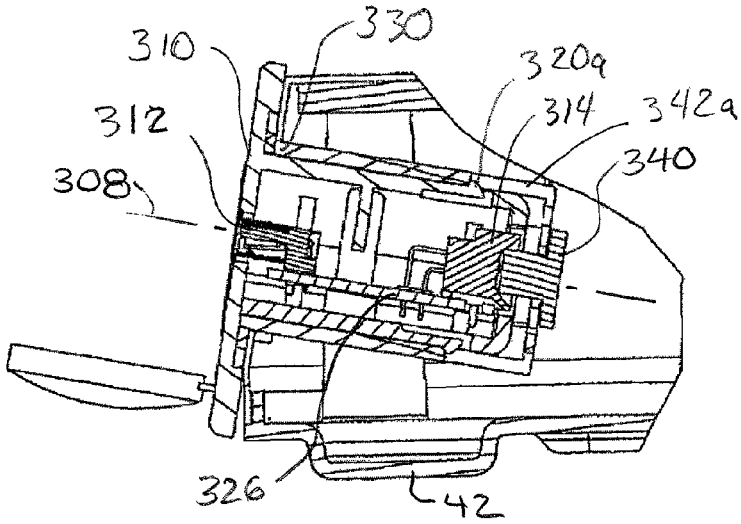
FIG. 16 is a side cross-sectional view taken along an axial centerline of the receptacle of FIG. 15 and the upgradable snap-lock USB converter plug of FIG. 14 inserted in the receptacle.

FIG. 15 is a partial cut-away side cross sectional view taken along an axial centerline 308 of an adapter receptacle 330 formed or rigidly connected in a lamp base 42 for receiving a replaceably securable USB adapter plug 310 (of FIGS. 14 and 16). The adapter receptacle 330 includes an electrical plug receiving portion 340 and a mechanical engagement portion 342. The plug receiving electrical connection portion 340 receives electrical power from the electrical conversion circuit of the lamp base 42. The plug receiving electrical connection portion may include mating male and/or female connector prongs or contacts for connecting to electrical connection portion of the upgradable replaceably securable USB adapter plug when the mechanical engagement portion 316 of the replaceably securable USB adapter plug engages with the mechanical engagement portion 340 of the adapter receptacle 330. In one or more embodiments, the adapter receptacle 330 is a snap-lock receptacle 330 mounted in the lamp base 42, which supports a lamp 40 from a table, floor or other surface (not shown in FIG. 14, see FIG. 3). The snap-lock receptacle 330 is configured for receiving an upgradable snap-lock USB adapter plug 310 of FIG. 14. In one embodiment, the mechanical securing portion of the adapter receptacle 330 included openings or detents 332*a* and 332*b* in opposed internal sides of the adapter receptacle 330 for engaging the hook portions of the replaceable snap-lock USB adapter plug 310.

FIG. 16 is a side cross sectional view taken along an axial centerline of the receptacle of FIG. 15 and the upgradable snap-lock USB adapter plug of FIG. 14 inserted and secured by outward spring action of the fingers pushing the hook tabs into holes or depressions formed in the sides of the snap-lock receptacle.

Under current standards the voltage for either USB version 1.1 or USB version 2.0 are at 5 volts DC. The 5 volts DC may be supplied by an additional circuit on the conversion circuit 80 within the lamp base. The inventor has found that it is useful to provide the USB snap-lock receptacle with a DC voltage and current at connector 340. This may usefully be 20-24 volts DC and may alternatively be the same DC voltage as supplied to the automotive receptacle 194 (nominally 12 V DC). Twenty to twenty-four volts is typically as high as manufacturing standards might permit, without other features such as double insulation, to avoid inadvertent shocks. Alternatively, use of 12 volts DC is sufficiently low and also permits using only one conversion circuit for both the automotive receptacle and for the upgradable USB snap-lock receptacle. Another DC to DC conversion circuit 326 is provided within the snap-lock USB adapter plug body 328 that converts the receptacle DC voltage to the standard USB voltage, presently 5 volts DC. The DC to DC conversion circuit 326 may be similar to the buck converter 160 depicted in FIG. 6. There are often changes in the standards for different kinds of technology such as USB ports. The use of a snap-lock USB adapter plug 310 allows for this possibility so that the snap-lock USB adaptor may receive at connector either the high 20-24 volts or the lower 12 volts DC can convert to the lower volts DC. If the standard voltage is lowered or raised an adapter with a different conversion circuit in an upgraded USB adapter plug can be securely replaceably connected into the receptacle, as by a snap lock engagement or by threaded connection to provide the new standard voltage without replacing the entire lamp.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A lamp and lamp base system for operating and recharging a portable electronic device comprising:

a lamp base:

a power source connected to the lamp base, wherein a standard household electrical current at standard household voltage is received into the lamp base;

a support attached to the lamp base;

a light fixture attached through the support to the lamp base, wherein an illumination element holding device is attached to and supported from the lamp base to form the lamp;

a direct circuit for connecting the standard household electrical current and voltage to the light fixture;

an automotive cigarette lighter receptacle held in the lamp base for connection to an operating and recharging unit for a portable electronic device, wherein the automotive cigarette lighter receptacle comprises an electrical plug receiving portion and a mechanical securing portion;

a conversion circuit connected between the power source and the automotive cigarette lighter receptacle, wherein the standard household electrical current and voltage from the power source is converted to a standard automotive voltage and current, wherein an operating and recharging unit that requires standard automobile electrical voltage and current may be plugged into the automotive cigarette lighter held in the lamp base for operating and recharging the portable electronic device; and a USB adapter comprising an adapter receptacle and an upgradeable USB adapter plug with an electrical connection portion, a mechanical engagement portion, and standard USB connector so that the electrical connection portion connects to the adaptor plug and receptacle when the mechanical engagement portion of the adapter receptacle engages the mechanical engagement portion of the USB adapter plug and having a USB conversion circuit for converting the standard automobile electrical voltage and current provided to the adapter receptacle into a standard USB voltage and current and so that the upgradeable USB adapter plug may be replacably secured to provide the USB connector with a standard USB voltage and current.

2. The lamp and lamp base system of claim 1, wherein the first conversion circuit provides standard automotive voltage and current to the adapter receptacle so that the upgradeable USB adapter plug comprises a second conversion circuit that converts the automotive voltage and current to a standard USB voltage and current and so that the upgradeable adapter USB plug may be replaced and upgraded with another USB adapter plug having a third conversion circuit to convert to a different USB voltage and current if the USB standard voltage is changed.

3. The lamp and lamp base system of claim 2, wherein the adapter receptacle comprises a snap-lock receptacle and the upgradeable USB adapter plug comprise a snap-lock USB adapter plug.

4. A lamp and lamp base system for operating and recharging a portable electronic device comprising:

a lamp base:

a power source connected to the lamp base, wherein a standard household electrical current at standard household voltage is received into the lamp base;

a light fixture attached through a support from the lamp base, wherein an illumination element holding device is attached to the base to form the lamp;

a direct circuit for connecting the standard household electrical current and voltage to the light fixture;

an automotive cigarette lighter receptacle securely held in the lamp base for connection to an operating and recharging unit for a portable electronic device;

a first conversion circuit connected between the power source and the automotive cigarette lighter receptacle, wherein the standard household electrical current and voltage from the power source is converted to a standard automotive voltage and current, wherein an operating and recharging unit that requires standard automobile electrical voltage and current may be plugged into the automotive cigarette lighter held in the lamp base for the operating and recharging unit for the portable electronic device;

a snap-lock receptacle in the lamp base electrically connected to the conversion circuit, wherein the conversion circuit provides a voltage and current to the snap-lock receptacle;

a replaceable snap-lock USB adapter plug comprising a second conversion circuit for converting the standard automobile electrical voltage and current provided to the adapter receptacle into a standard USB voltage and current and so that the replaceable snap-lock USB adapter plug may be unlocked, removed, and replaced with an upgraded replacement snap-lock USB adapter plug having a third conversion circuit to convert the voltage and current provided to a different USB voltage and current.

5. The lamp and lamp base system of claim 4, wherein the first conversion circuit receives household standard electrical power in a range of about 110 to 120 volts AC and converts the standard household electrical voltage and current to another electrical voltage and current in a range of about 11-13 volts DC that is supplied to the charging receptacle.

6. The lamp and lamp base system of claim 4, wherein the first conversion circuit comprises an AC to DC conversion circuit and a DC to DC conversion circuit.

7. The lamp and lamp base system of claim 4, wherein a standard household plug receptacle is held in the lamp base and connects directly to the power source for providing standard AC plug access to standard AC household current at the same time that access to automotive DC voltage and current is provided to the automotive cigarette lighter receptacle.

8. The lamp and lamp base system of claim 4, comprising an adapter receptacle for a USB adapter and wherein the second conversion circuit provides standard USB voltage and current to the adapter receptacle for access by the USB adapter plug at the same time that access to automotive DC voltage and current is provided at the automotive cigarette lighter receptacle.

9. The lamp and lamp base system of claim 4, comprising a cover movably connected for over laying the automotive receptacle when not in use.

10. The lamp and lamp base system of claim 4, comprising a switch for selectively connecting and disconnecting the converted standard automotive voltage and current to the automotive cigarette lighter receptacle.

11. The lamp and lamp base system of claim 4, comprising an indicator light for indicating when the converted standard automotive voltage and current is available at the automotive cigarette lighter receptacle.

12. A lamp and lamp base system for operating and recharging a portable electronic device comprising:

a lamp base:

a power source connected to the lamp base, wherein a standard household electrical current at standard household voltage is received into the lamp base;

a support attached to the lamp base;

a light fixture attached through the support to the lamp base, wherein an illumination element holding device is attached to the base to form the lamp;

a direct circuit for connecting the standard household electrical current and voltage to the light fixture;

an automotive cigarette lighter receptacle held in the lamp base for connection to an operating and recharging unit for a portable electronic device;

a conversion circuit connected between the power source and the automotive cigarette lighter receptacle, wherein the standard household electrical current and voltage from the power source is converted to a standard automotive voltage and current, wherein an operating and recharging unit that requires standard automobile electrical voltage and current may be plugged into the automotive cigarette lighter held in the lamp base for operating and recharging the portable electronic device; and an adapter receptacle with securable replacement connection, wherein the conversion circuit provides a voltage and current to the adapter receptacle;

a replaceably securable USB adapter plug comprising a USB connector and a second conversion circuit for converting the voltage and current provided to the adapter receptacle into a standard USB voltage and current provided to the USB connector and so that the replaceably securable USB adapter plug may be unsecured and replaced with an upgraded replaceably securable USB adapter plug having an upgraded USB connector and an upgraded third conversion circuit to convert the voltage and current provided to an upgraded USB voltage and current.

13. The lamp and lamp base system for operating and recharging a portable electronic device of claim 12, wherein the adapter receptacle with securable replacement connection comprises a replaceable snap-lock USB adapter receptacle comprising a electrical receiving connection portion and mechanical engagement snap-lock receiving portion so that the replaceably securable USB adapter plug connects with the electrical connection receiving portion of the replaceable snap-lock USB adapter receptacle when a mechanical engagement snap-lock portion of the USB adapter plug engages the snap-lock receiving portion.

14. A lamp base comprising:

a power source connected to the lamp base, wherein a standard household electrical current at standard household voltage is received into the lamp base;

a support attached to the lamp base;

a light fixture attached through the support to the lamp base;

a direct circuit for connecting the standard household electrical current and voltage to the light fixture;

a snap-lock receptacle in the lamp base electrically connected to the conversion circuit, wherein the conversion circuit provides a voltage and current to the snap-lock receptacle;

a replaceable snap-lock USB adapter plug comprising a USB connector and a second conversion circuit for converting the standard automobile electrical voltage and current provided to the adapter receptacle into a standard USB voltage and current and so that the replaceable snap-lock USB adapter plug may be unlocked, removed, and replaced with an upgraded replacement snap-lock USB adapter plug having a third conversion circuit to convert the voltage and current provided to a different USB voltage and current.

* * * * *